US008662186B2

(12) United States Patent
Robles

(10) Patent No.: US 8,662,186 B2
(45) Date of Patent: Mar. 4, 2014

(54) DOWNHOLE BACKSPIN RETARDER FOR PROGRESSIVE CAVITY PUMP

(75) Inventor: Jorge Robles, Edmonton (CA)

(73) Assignee: Weatherford/Lamb, Inc., Houston, TX (US)

( * ) Notice: Subject to any disclaimer, the term of this patent is extended or adjusted under 35 U.S.C. 154(b) by 278 days.

(21) Appl. No.: 13/048,383

(22) Filed: Mar. 15, 2011

(65) Prior Publication Data

US 2012/0237380 A1 Sep. 20, 2012

(51) Int. Cl.
*E21B 43/00* (2006.01)

(52) U.S. Cl.
USPC ..... 166/372; 166/241.2; 166/241.3; 166/241.4

(58) Field of Classification Search
USPC ..... 166/372, 241.2, 241.3, 241.4
See application file for complete search history.

(56) References Cited

U.S. PATENT DOCUMENTS

| | | | | |
|---|---|---|---|---|
| 4,050,514 | A | 9/1977 | Prenn | |
| 5,209,294 | A | 5/1993 | Weber | |
| 5,358,036 | A | 10/1994 | Mills | |
| 5,551,510 | A | 9/1996 | Mills | |
| 5,873,157 | A | 2/1999 | Hart et al. | |
| 5,941,305 | A | 8/1999 | Thrasher et al. | |
| 5,960,886 | A | 10/1999 | Morrow | |
| 6,039,115 | A | 3/2000 | Mills | |
| 6,079,489 | A | 6/2000 | Hult et al. | |
| 6,092,595 | A * | 7/2000 | Fecht et al. | 166/68 |
| 6,125,931 | A | 10/2000 | Hult et al. | |
| 6,135,740 | A * | 10/2000 | Hult et al. | 418/69 |
| 6,152,231 | A | 11/2000 | Grenke | |
| 6,786,309 | B2 | 9/2004 | Saruwatari et al. | |
| 6,843,313 | B2 | 1/2005 | Hult | |
| 7,044,217 | B2 | 5/2006 | Hult | |

(Continued)

FOREIGN PATENT DOCUMENTS

| | | |
|---|---|---|
| CA | 2281727 A1 | 3/2001 |
| CA | 2187579 | 3/2003 |
| CA | 2530782 A1 | 6/2007 |

OTHER PUBLICATIONS

"Artificial Lift: What's new in artificial lift, Part 1—Twenty two new systems for beam, progressing cavity, hydraulic pumping and plunger lift," by James F. Lea and Herald W. Winkler, Texas Tech University, Lubbock, TX; Henry V. Nickens, BP Amoco; and Robert E. Snyder, Editor. World Oil, Mar. 2000, 9 pgs.

(Continued)

*Primary Examiner* — Cathleen Hutchins
(74) *Attorney, Agent, or Firm* — Wong, Cabello, Lutsch, Rutherford, Brucculeri LLP

(57) ABSTRACT

A backspin retarder for a progressive cavity pump deploys on the drive string uphole from a pump unit. The backspin retarder has a shaft that connects to portions of the drive string. An impeller disposes on the shaft and can move axially and radially. In an unengaged condition, the impeller and shaft can rotate relative to one another so the drive string can rotate in a drive direction without impediment from the impeller. In an engaged condition, the impeller rotates with the shaft in a backspin direction. In this way, vanes on the impeller can retard the backspin of the shaft and drive string by attempting to force the lifted fluid column flowing downhole past the impeller back uphole. The retarder can use a pin and slot arrangement or an arrangement of engageable teeth to engage the impeller to the rotation of the shaft.

37 Claims, 9 Drawing Sheets

(56) References Cited

U.S. PATENT DOCUMENTS

| | | | |
|---|---|---|---|
| 7,806,665 | B2 | 10/2010 | Mello et al. |
| 2001/0030046 | A1 | 10/2001 | Haseloh |
| 2005/0045323 | A1 | 3/2005 | Hult |
| 2007/0292277 | A1 | 12/2007 | Grenke |
| 2008/0135358 | A1 | 6/2008 | Villa et al. |
| 2008/0142209 | A1 | 6/2008 | Mello et al. |
| 2008/0199339 | A1 | 8/2008 | Near |
| 2008/0257555 | A1 | 10/2008 | Waldenstrom et al. |
| 2008/0296011 | A1 | 12/2008 | Hult |

OTHER PUBLICATIONS

Examiner's First Report received in corresponding Australian Application No. 2012201318, dated Jun. 13, 2013.

First Office Action in corresponding Canadian Appl. 2,770.926, dated Aug. 30, 2013.

European Search Report in corresponding European Appl. 12 15 9519, dated Nov. 5, 2013.

* cited by examiner

DOWNHOLE BACKSPIN RETARDER FOR PROGRESSIVE CAVITY PUMP

BACKGROUND

Progressive cavity pump (PCP) systems are used for artificial oil lifting operations on wellheads. The PCP systems have a drive head at the surface and a rotor and stator downhole. The drive head rotates a rod string that turns the rotor in the stator. This lifts a fluid column up a tubing string to be produced at the surface.

The PCP systems tend to store energy in the rod string and the lifted column of fluid. This stored energy can be problematic if the release of the energy is not controlled properly when the well is shut off. Various breaking and decelerating devices have been developed for surface drive heads to control the release of the stored energy. Unfortunately, current devices can be expensive and may not be effective in every situation.

One downhole device for dealing with the stored energy uses a dump valve to direct fluid out of the tubing to the annulus. When opened, the dump valve prevents the column of fluid from going through the pump and generating hydraulic energy that causes backspin on the rod string. Another downhole device uses a check valve at the pump intake. The check valve holds the weight of the fluid column above the pump and keeps it from going through the pump and generating the hydraulic energy that causes backspin on the rod string. Although these downhole devices may deal with the problem, these devices can create improper rotor spacing and can reduce the pump's efficiency. Moreover, if these downhole devices fail, then operators must deal with the full stored energy.

The most common devices to control the release of the stored energy are used at the surface. Various surface devices can use braking to control the release of stored energy in the rod string. The braking can use direct mechanical braking, hydraulic braking, centrifugal braking, or the like at the surface drive head. However, one major limitation to the surface devices is their inability to dissipate the tremendous amount of heat that they can produce. For example, the ISO standard for PCP drive heads may require a temperature below a certain limit (e.g., 150° C.) during backspin. The defined limit can eliminate the feasibility of using certain braking devices due to the large amount of energy that could potentially be stored in the fluid column filling the tubing.

To overcome the thermal limitations of such surface devices, operators have designed oversized equipment, which increases costs. Operators have also designed the surface devices to limit the reverse backspin velocity that can be achieved when controlling the release of the stored energy. For example, systems may use a variable speed driver (VSD) on the permanent magnet or induction motor to apply torque during backspin. To use these systems during a power blackout, the system needs either permanent magnets or additional capacitors. In another example, the surface device may use a small choke in a hydraulic brake. However, this solution has a negative impact on the operation of the PCP system because it increases the amount of time required to release the energy before production can be resumed or before well intervention can be initiated.

The subject matter of the present disclosure is directed to overcoming, or at least reducing the effects of, one or more of the problems set forth above.

SUMMARY

A backspin retarder is used for a progressive cavity pump. At the surface, the progressive cavity pump has a drive unit that imparts rotation to a drive string disposed in a tubing string. Downhole, the progressive cavity pump has a pump unit coupled to the rotation of the drive string. As the pump unit operates, it lifts a column of produced fluid up the tubing string.

The backspin retarder can deploy on the drive string in a number of positions, including deploying at some point uphole from the pump unit, deploying below the pump as an extension of the rotor, deploying between two pumps (e.g., tandem or charge pumps), or deploying in a combination of these positions. In general, the backspin retarder can be used alone or in combination with a braking system or other device at the surface that controls backspin of the drive string.

The backspin retarder has a shaft and an impeller. The shaft connects to portions of a drive string for the progressive cavity pump, and the shaft can have rod connectors for coupling to sections of sucker rod or the like using couplings, for example.

For its part, the impeller disposes on the shaft and can rotate and move axially thereon. On its outer surface, the impeller can have a plurality of vanes that run straight along the impeller or have a counter-clockwise twist along the impeller's length. When moved axially on the shaft, the impeller can have engaged and disengaged conditions relative thereto.

The impeller has the disengaged condition at least when the shaft rotates in a drive (e.g., clockwise) direction. However, fluid downhole of the impeller flowing uphole past the impeller also tends to disengage the impeller. In the disengaged condition, the impeller and shaft can rotate relative to one another. This allows the drive string to rotate in the drive direction while the impeller remains stationary relative to the tubing string, although the impeller may rotate even in the counterclockwise direction.

In the engaged condition, however, the impeller rotates with the shaft to retard backspin of the drive string using drag from the impeller's vanes. The impeller has the engaged condition at least when the shaft rotates in a backspin (e.g., counter-clockwise) direction. During backspin, the pump does not lift fluid so lifted fluid uphole of the impeller flows downhole past the impeller. As this happens, the impeller tends to move to the engaged condition so that it will rotate with the shaft and drive string. As will be appreciated, the shape and dimensions of the vanes and impeller can be designed to favor engagement and the retarding effect.

The retarder can use a number of mechanisms to engage and disengage the impeller to the rotation of the shaft depending on whether the core shaft is rotating in the drive direction or the backspin direction. In one arrangement, for example, the impeller defines one or more slots in an internal bore of the impeller, and the shaft has one or more pins or set of pins for disposing in the one or more slots. The pins can be arranged radially or axially on the shaft. Each slot defines a circumferential or free wheel section defined around the internal bore and defines at least one catch section extending therefrom.

Each pin disposes in the circumferential section when the impeller has the disengaged condition so that the pin can move in the circumferential section freely as the shaft rotates relative to the impeller. The shaft's pin disposes in the at least one catch section, however, when the impeller has the engaged condition. In this instance, the pin enters the at least one catch section when the impeller moves downhole on the shaft and the shaft rotates in the backspin direction. With the pin in the catch section, the impeller can rotate with the shaft in the backspin direction to produce the desired drag.

In another arrangement, the shaft has shoulders uphole and downhole of the impeller that limit axial movement of the impeller thereon. The downhole shoulder can engage the downhole end of the impeller in the engaged condition so the impeller rotates with the shaft. For example, the downhole shoulder and end can have corresponding teeth that permit clockwise rotation relative thereto, but that restrict counter-clockwise rotation. Additionally, multiple forms of engagement can be used together on the impeller. For example, engagement from a downhole shoulder can be used in conjunction with engagement from one or more internal pin/slot arrangements. These and other forms of engagement can be used.

The foregoing summary is not intended to summarize each potential embodiment or every aspect of the present disclosure.

DETAILED DESCRIPTION

Figure 1A:
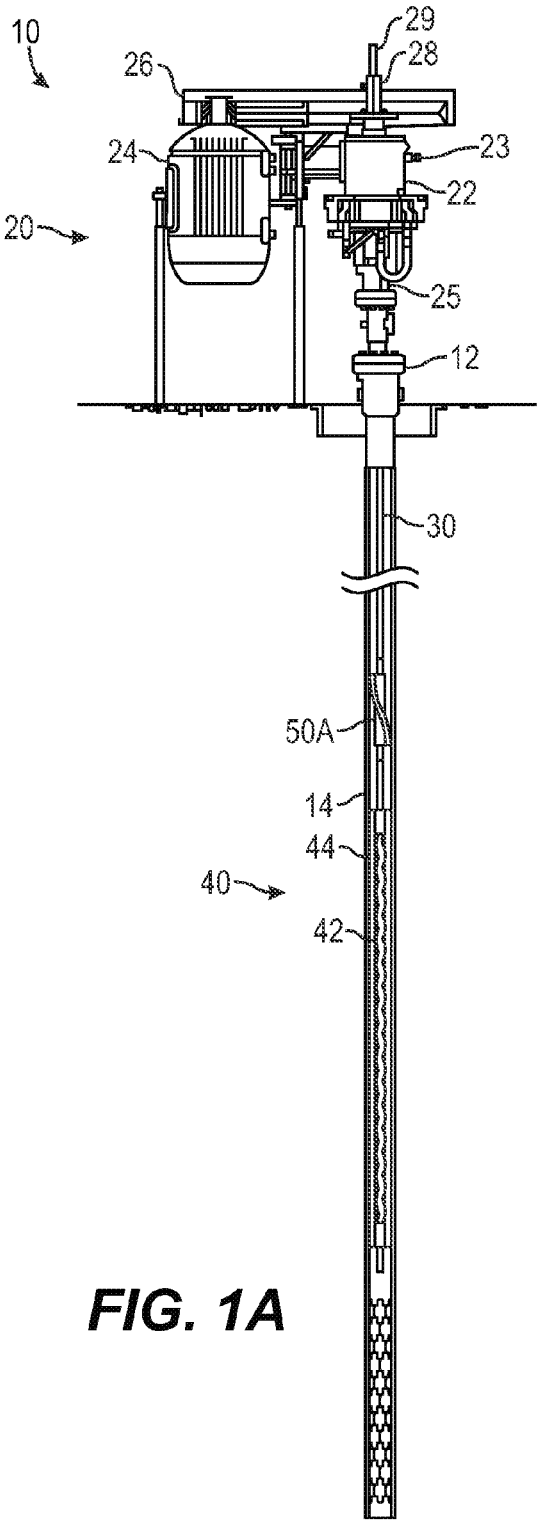
FIGS. 1A-1C illustrate a progressive cavity pump system having downhole backspin retarders according to the present disclosure.

A progressive cavity pump system 10 shown in FIG. 1A is used for a wellhead 12. The progressing cavity pump system 10 has a surface drive 20, a drive string 30, and a downhole progressive cavity pump unit 40. At the surface of the well, the surface drive 20 has a drive head 22 mounted above the wellhead 12 and has an electric or hydraulic motor 24 coupled to the drive head 22 by a pulley/belt or gearbox assembly 26. The drive head 22 typically includes a stuffing box 25, a clamp 28, and a polished rod 29. The stuffing box 25 is used to seal the connection of the drive head 20 to the drive string 30, and the clamp 28 and the polished rod 29 are used to transmit the rotation from the drive head 22 to the drive shaft 30.

Downhole, the pump unit 40 installs below the wellhead 12 at a substantial depth (e.g., about 2000 m) in the wellbore. Typically, the pump unit 40 has a single helical-shaped rotor 42 that turns inside a double helical elastomer-lined stator 44. During operation, the stator 44 attached to the production tubing string 14 remains stationary, and the surface drive 20 coupled to the rotor 42 by the drive string 30 causes the rotor 42 to turn eccentrically in the stator 44. As a result, a series of sealed cavities form between the stator 42 and the rotor 44 and progress from the inlet end to the discharge end of the pump unit 40, which produces a non-pulsating positive displacement flow.

Because the pump unit 40 is located near the bottom of the wellbore, which may be several thousand feet deep, pumping oil to the surface requires very high pressure. The drive string 30 coupled to the rotor 42 is typically a steel stem having a diameter of approximately 1" and a length sufficient for the required operations. During pumping, the string 30 may be wound torsionally several dozen times so that the string 30 accumulates a substantial amount of stored energy. In addition, the height of the fluid column above the pump unit 40 can produce hydraulic energy on the drive string 30 while the pump unit 40 is producing. This hydraulic energy increases the energy of the twisted string 30 because it causes the pump unit 40 to operate as a hydraulic motor, rotating in the same direction as the twisting of the drive string 30.

The sum total of all the energy accumulated on the drive string 30 will return to the wellhead when operations are suspended for any reason, either due to normal shutdown for maintenance or due to lack of electrical power. A braking system (not shown) in the drive 20 is responsible for blocking and/or controlling the reverse speed resulting from suspension of the operations. When pumping is stopped, for example, the braking system is activated to block and/or allow reverse speed control and dissipate all of the energy accumulated on the string 30. Otherwise, the pulleys or gears of the assembly 26 would disintegrate or become damaged due to the centrifugal force generated by the high rotation that would occur without the braking system.

As one example, the braking system can have a brake screw 23 that can be operated directly by an operator. Turning the brake screw 23 can apply or release an internal brake shoe that, in turn, presses on a rotating drum, causing a braking effect to string 30. Other braking systems based on hydraulics, centrifugal force, and the like can also be used.

In addition to or as an alternative to the surface braking system, the system 10 has one or more downhole retarders 50 that install at various locations along the drill string 30. During backspin, the retarders 50 release stored energy of the drill string 30 downhole in the well as opposed to having the surface braking system exclusively release the energy at the surface. As detailed below, this has a number of benefits for progressive cavity pump operations.

Figure 1B:
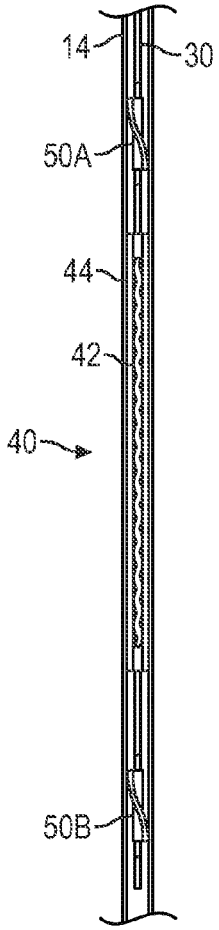

As shown in FIG. 1A, one or more retarders 50A can install on the drive string 30 above the pump unit 40. As shown in FIG. 1B, one or more other retarders 50B can be used in addition or as an alternative to the retarders 50A above the pump unit 40, and these retarders 50B can deploy below the pump unit 40 as an extension of the rotor 42. Moreover, one or more retarders 50C as in FIG. 1C can deploy between two pump units 40 (e.g., tandem or charge pumps). These and other arrangements are possible.

Either way, the disclosed retarder 50 uses fluid momentum and drag force to retard backspin produced in the drive string 30 at least when the drive string 30 stops rotation in its drive direction. By retarding the backspin, the retarder 50 can then reduce the amount of stored energy that must be handled by the surface braking system. Overall, this retarding of backspin can reduce the amount of heat that must be dissipated at the surface. Likewise, the backspin retarding can decrease the amount of time it takes to deal with the stored energy at the surface.

Figure 1C:
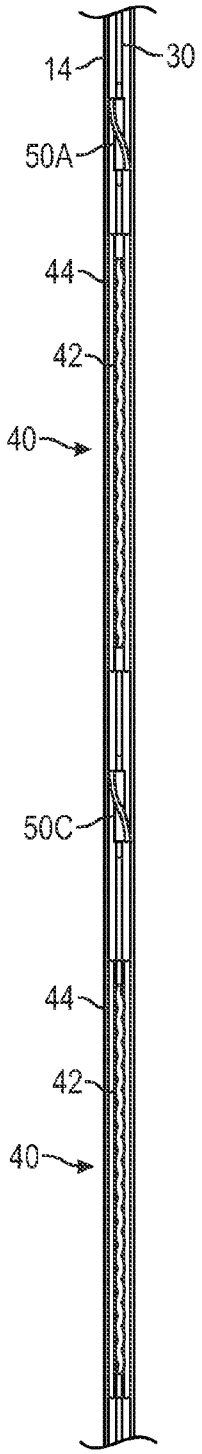

In general, the retarder 50 may have any suitable length along the drive string 30. Although a few retarders 50A-C are shown in FIGS. 1A-1C, multiple retarders 50 can be disposed at various points along the length of the drive string 30. Use of such multiple retarders 50 may be beneficial in some implementations because the retarders 50 can control backspin of the drive string 30 at strategic points along the string 30.

Figure 2:
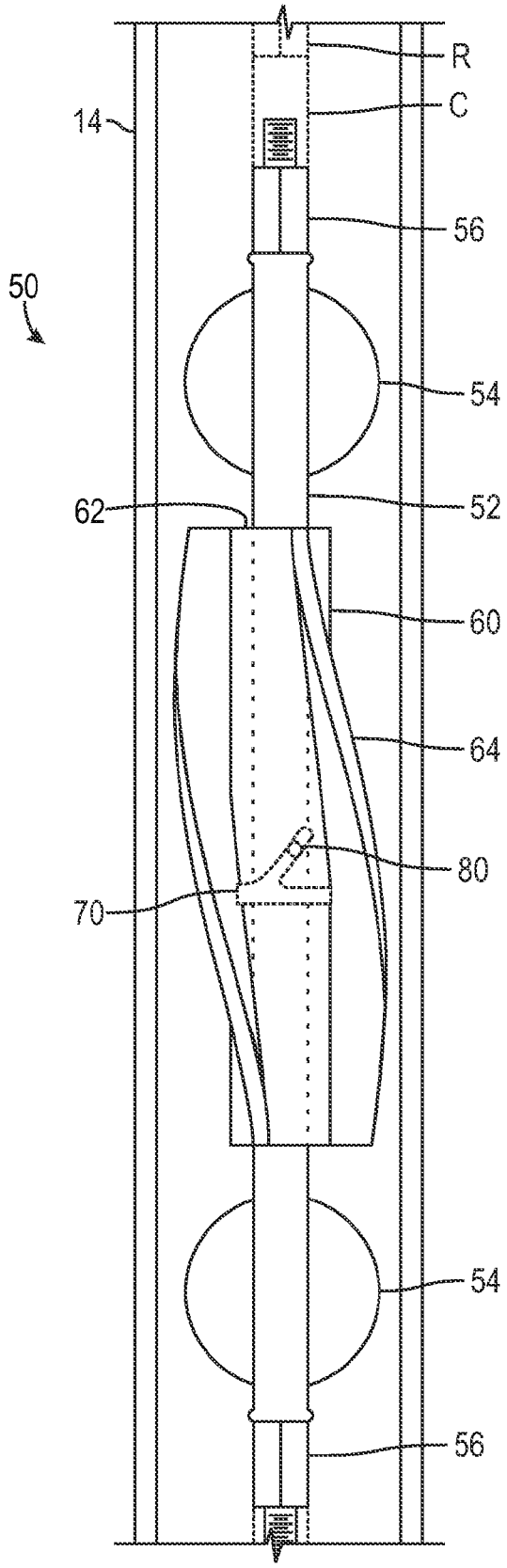
FIG. 2 shows a backspin retarder in isolated detail.

As shown in FIG. 2, one arrangement of a retarder 50 has a core shaft 52 that attaches to the rod string with connector ends 56. For example, the core shaft 52 can be a sucker rod section, and the connector ends 56 can have flats and threaded couplings. The connector ends 56 can connect to couplings C and upper and lower sucker rods R using standard techniques. Any suitable form of centralizer 54 for drive strings can be used on the core shaft 52 to help stabilize the assembly.

A set of pins 80 extend radially outward from the core shaft 52, and an external impeller 60 of the retarder 50 installs on the core shaft 52 at the location of the pins. Being a section of sucker rod, the core shaft 52 is preferably composed of suitable metal material. For the impeller 60, various materials can be used, such as polymer, composite, metal, or the like, and the impeller 60 can be formed by machining, molding, and the like. In addition, the impeller 60 can use a combination of materials to improve performance. For example, some parts can be composed of metal to achieve strength, while others can be composed of plastic to reduce weight.

Figure 3:
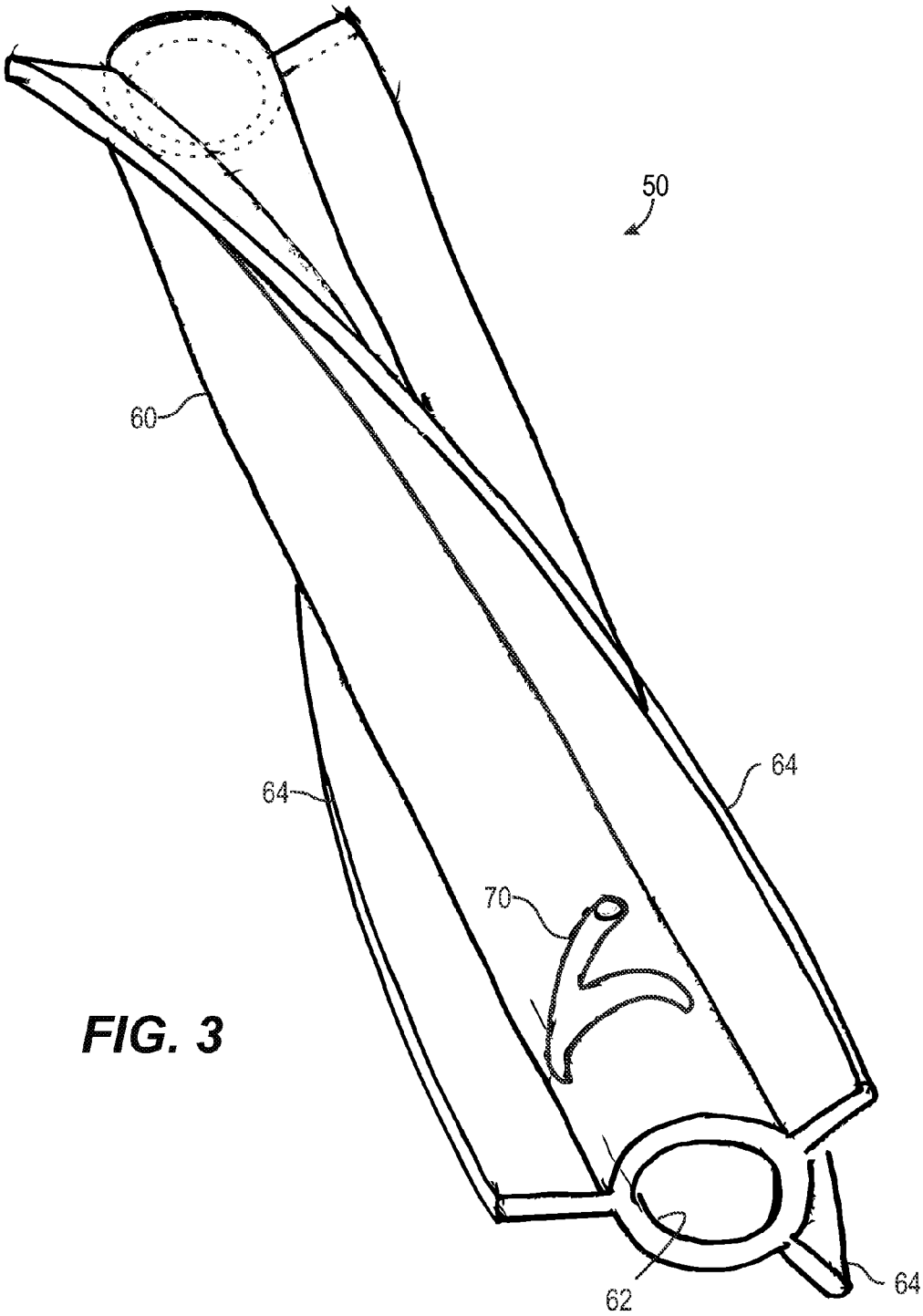
FIG. 3 shows a perspective view of an external impeller of the backspin retarder.

Inside the impeller 60, the central bore 62 has a slot 70 for the pins 80 on the core shaft 52. If desirable, bearings and/or seals (not shown) can be provided between the impeller's central bore 62 and the core shaft 52 as described later. Externally, the impeller 60 is equipped with vanes, blades, or fins 64. As shown in FIG. 3, for example, the impeller 60 can have three helical vanes 64 wound in a counter-clockwise twist along the length of the impeller 60. However, the shape and orientation of the vanes 64 can depend on the particular implementation. For example, more or less vanes 64 can be used, and the vanes 64 can be straight or twist along the length of the impeller 60 in any suitable fashion.

The impeller 60 can rotate on the core shaft 52 and can shift axially as well, but the arrangement of pins 80 and slot 70 limit the impeller's movement. The rotation of the shaft 52 and the flow of fluid past the vanes 64 further dictates the movement of the impeller 60, and provided in more detail below. As noted above, the retarder 50 releases stored energy of the drive string downhole in the well. As described below, interaction of the impeller 60 with fluid in the tubing 14 and the core shaft 52 accomplishes this release of energy.

When installed on a rod string, the core shaft 52 rotates as part of the rod string. Independently, the impeller 60 engages and disengages from the core shaft 52 using the pins 80 and slot 70. Whether the impeller 60 is engaged or disengaged is based on a combination of axial and rotational drag forces. For example, backwards flow of fluid during recoil (backspin) engages the impeller 60 with the shaft 52 so that the impeller rotates and pumps against the fluid equalization. In this way, the draft from the retarder's impeller 60 can enhance the release of backspin energy when used alone or in combination with other devices to release stored energy.

The length of the impeller 60 (and hence the resulting torque and energy release produced) can depend on the implementation. As one example, the impeller 60 can have a length of about 3-ft to about 10-ft. The vanes 60 can extend toward the surrounding tubing 14, but preferably avoid direct contact with the tubing's inner wall.

Figure 4:
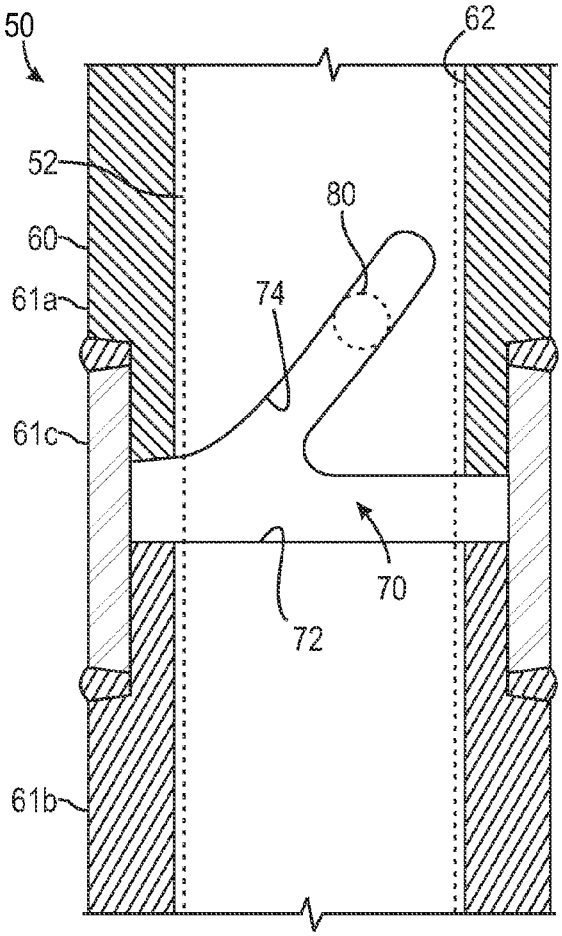
FIG. 4 shows a cross-sectional view of the external impeller and its internal groove.

In the detail shown in FIG. 4, the slot 70 for the impeller 60 has a free wheel channel 72 defined circumferentially around the central bore 62 of the impeller 60. The slot 70 also has angled catches 74 (one for each of the pins 80) on opposing sides of the bore 62. These angled catches 74 incline in an uphole and counter-clockwise manner in the inside surface of the bore 62 from the free wheel channel 72.

The slot 70 can be formed inside the internal bore 62 in a number of ways. For example, the slot 70 can be independently machined in the bore 62 using available techniques. Alternatively, the slot 70 can be formed using a number of impeller parts that affix together to facilitate assembly as shown in FIG. 4.

As shown, for example, the impeller 60 can be formed from three body sections 61*a-c*. One section 61*a* can define the angled catches 74 for engaging the heads of the pin 80 during backspin. The opposing section 61*c* can define the bottom edge of the free channel 72 of the slot 70. The intermediate section 61*b* can affix the two opposing sections 61*a* and 61*c* together and complete the slot 70. The sections 61*a-c* can affix together in any number of ways, such as by welding, threading, bonding, or the like depending on the materials used.

The slot 70 can be formed in a portion of the impeller 60 having the vanes 64 as shown in FIG. 3. Alternatively, the slot 70 can be formed on ends of the impeller 60 or in sections thereof that do not have vanes 64 to facilitate assembly. These and other possibilities are possible.

Figure 5:
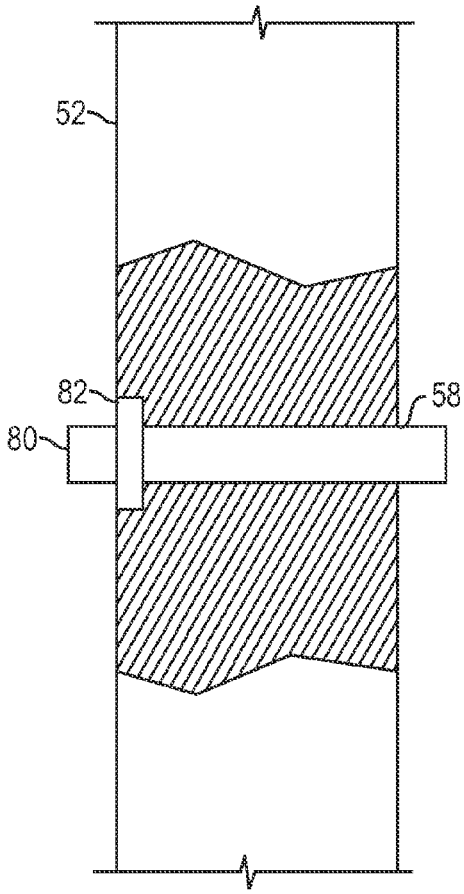
FIG. 5 shows a partial cross-section of the core shaft and pin.

As noted previously, the core shaft 52 preferably has a set of pins 80 opposing one another on either side of the shaft 52. The set of pins 80 can be formed on the shaft 52 in a number of available ways known in the art. As shown in FIG. 5, for example, a pin 80 positions through a cross bore 58 in the shaft 52. A nut 82 counter sunk in the shaft 52 can fasten the pin 80 to the shaft 52. In the end, two heads of the pin 80 oppose one another on the shaft 52 and form the set of pins for the shaft 52 to engage the impeller's slot 70 as disclosed herein.

During operation of the progressive cavity pump system 10 of FIGS. 1A-1C, the rod string 30 rotates from the surface drive 20 to operate the downhole pump unit 40. The rotating rod string 30 rotates the retarder's core shaft 52 in a first (clockwise) direction. The rotating rod string 30 operates the pump unit 40, which lifts a fluid column up the tubing string 14. This lifted fluid column then passes by the retarder 50 during operation of the pump unit 40 to the surface, where it is produced.

Figure 6A:
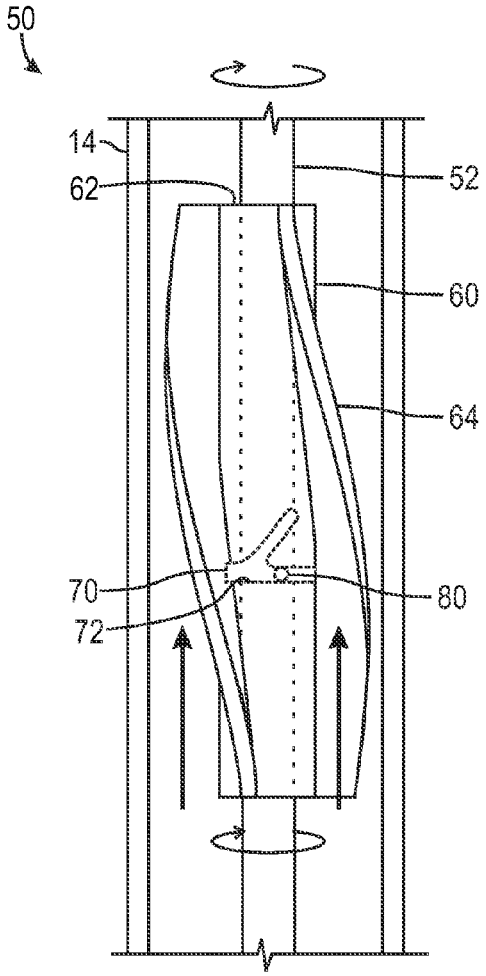
FIGS. 6A-6B show the backspin retarder in two stages of operation.

As shown in FIG. 6A, the pins 80 tend to position within the free wheel channel 72 of the slot 70 during this normal pump lift operation. In particular, the upward drag force between the lifted fluid and the impeller 60 tends to push the impeller 60 uphole on the core shaft 52, tending the position the pins 80 in the free wheel channel 72. This uphole tendency of the impeller 60 can be combined further with the rotational drag of the impeller 60 and the normal force between the pins 80 and the walls of the angled catches 74 of the slot 70 to help position the pins 80 in the free wheel channel 72. In this orientation, the core shaft 52 can rotate freely in the bore 62 of the impeller 60, which may tend to remain stationary in the tubing 14 or may even rotate counter-clockwise.

At some point during operation of the drive 20 of FIG. 1A, rotation of the rotating rod string 30 may stop. The built up torsion in the string 30 and the fluid column above the pump unit 40 tends to create backspin on the string 30 as it attempts to release the stored energy. When the backspin motion starts, the fluid column above the retarder 50 falls downhole in the tubing string 14.

Figure 6B:
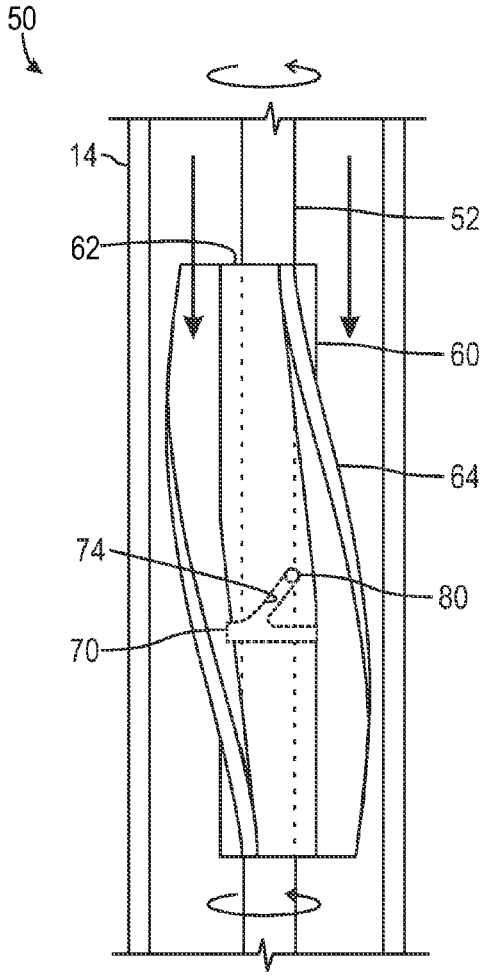

As shown in FIG. 6B, the downward drag between the falling fluid column and the impeller 60 tends to move the impeller 60 downhole on the core shaft 52 into an engaged position. Rather than riding in the free wheel channel 72 of the slot 70, the pins 80 on the core shaft 52 in the engaged condition catch in the angled catches 74 of the slot 70. Thus, the impeller 60 spins counter-clockwise with the core shaft 52. As this occurs, the back-spinning impeller 60 tries to move the fluid column back uphole in the tubing 14 while the fluid is falling back downhole. Using the force of the fluid, the retarder 50 slows the backspin because the resulting torque tends to decelerate the backspin of the core shaft 52. Over the course of the release of the backspin, the torque from the retarder 50 can release a portion of the stored energy downhole instead of at the surface.

Overall, the viscous friction (drag force) from the impeller 60 releases energy downhole and reduces the amount of braking and heat dissipation needed at the surface. At a minimum, the downhole retarder 50 slows the rate of energy release at the surface and reduces the surface drive head braking energy input rate. This can allow for more time for energy to dissipate and can reduce the peak temperature at the drive head.

Although not shown in each arrangement, the shaft 52 of the disclosed retarders 50 can have end caps or shoulders disposed above and below the ends of the impeller 60. These end caps can provide protection to the impeller 60 and can limit its axial movement. Of course, the end caps let the impeller 60 move axially on the shaft 52 the required distance.

Figure 7A:
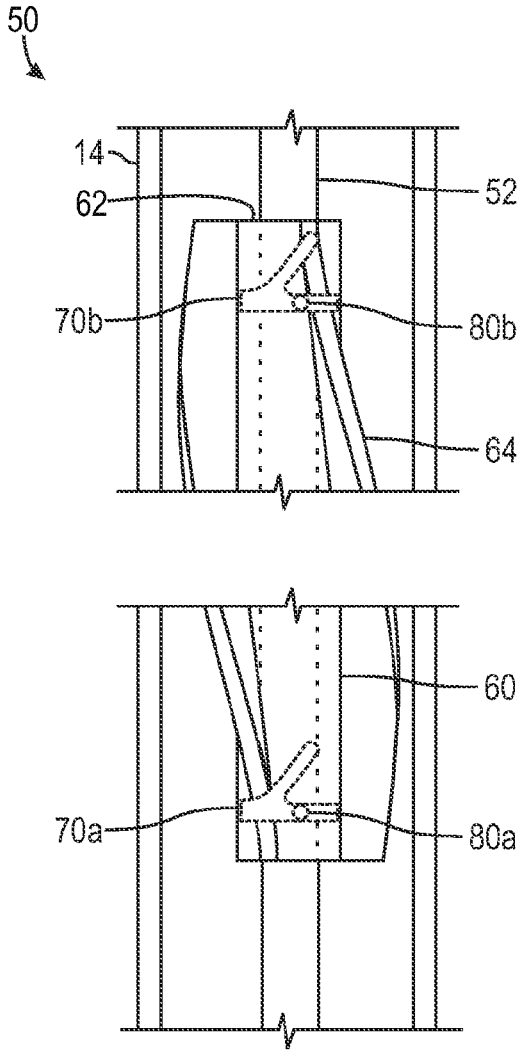
FIGS. 7A-7B show alternate arrangements for the disclosed backspin retarder.

Although one slot 70 and set of pins 80 are shown, the retarder 50 can have a number of slots 70 and sets of pins 80. These can be positioned at various intervals along the length of the retarder 50. For example, FIG. 7A shows a retarder 50 having slots 70*a-b* on both ends of the retarder 50. Similarly, the core shaft 52 can have corresponding sets of pins 80*a-b* for these slots 70*a-b*.

Figure 7B:
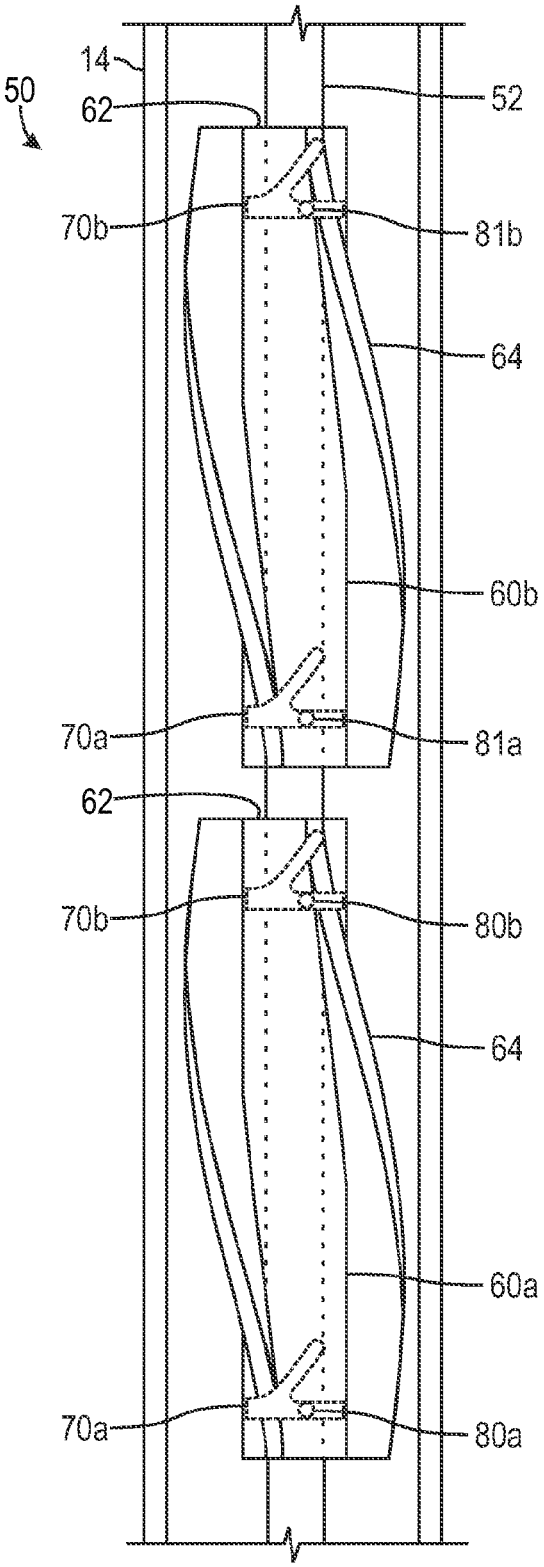

Depending on the particular needs, the retarder 50 can have one long or short impeller 60 as disclosed above. Yet, the retarder 50 can use more than one impeller 60. For example, a retarder 50 in FIG. 7B has two impellers 60*a-b* disposed on the shaft 52. These can be separated by a gap of any suitable distance, and they can be separately rotatable on the shaft 52. Alternatively, the multiple impellers 60*a-b* can be interconnected with one another. Each of the impellers 60*a-b* can have two or more slots 70*a-b*, and the shaft 52 can have dual sets of pins 80*a-b*, 81*a-b*. As also disclosed herein, each of the impellers 60*a-b* can have another system for engagement with the core shaft 52.

As noted previously, the engagement between the core shaft 52 and the impeller 60 can use an arrangement of pins 80 and slots 70. Other configurations can also be used. For example, engagement between the core shaft 52 and the impeller 60 can use an arrangement of teeth and shoulders. Moreover, different combinations of the various forms of engagement can be used on the impeller 60. For example, an arrangement of teeth and shoulder can be disposed at the bottom of the impeller 60, while an arrangement of slots 70 and pins 80 can be used internally on the impeller 60.

Figure 8A:
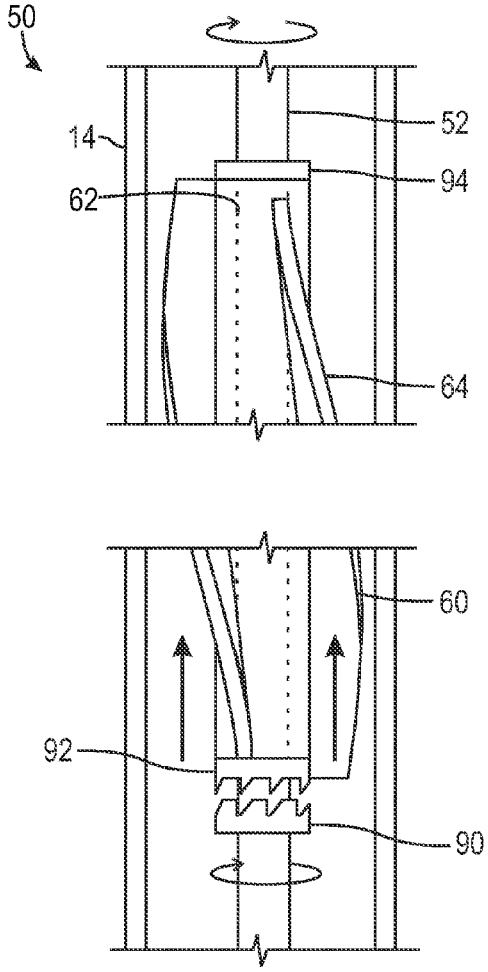
FIGS. 8A-8B show another downhole backspin retarder in two stages of operation using another form of engagement.
Figure 8B:
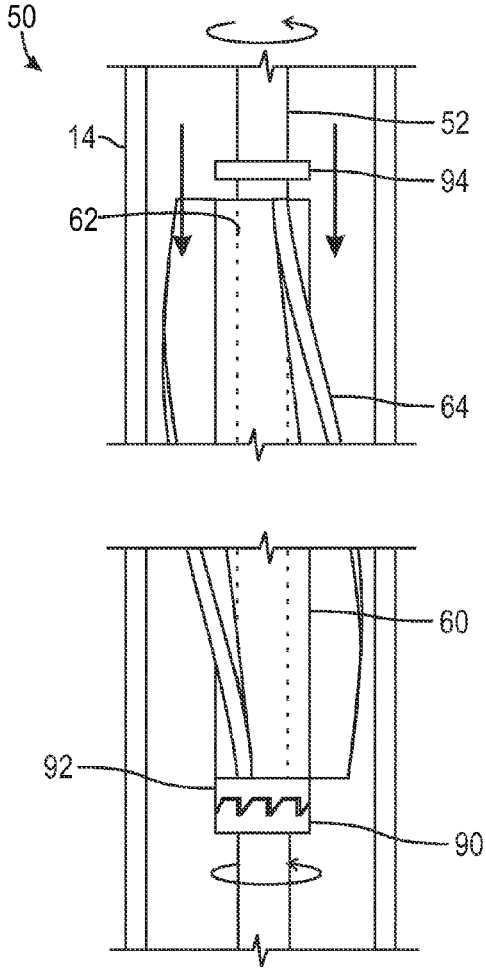

In one arrangement shown in FIGS. 8A-8B, the retarder 50 has an impeller 60 disposed on the core shaft 52 as before. At the uphole end, the shaft 52 has a shoulder 94 that limits the axial movement of the impeller 60 on the shaft 52. At the downhole end, the shaft 52 has an end cap 90 with angled teeth. The lower end of the impeller 60 also has a complementary end cap 92 with angled teeth. Together, the teeth on the end caps 90 and 92 permit clockwise rotation but prevent counter-clockwise rotation between the impeller 60 and shaft 52 when engaged.

As shown in FIG. 8A, the impeller 60 tends to position uphole during normal operation as the core shaft 52 rotates clockwise to operate a downhole pump unit (not shown). The upward drag force between the lifted fluid and the impeller 60 tends to push the impeller 60 uphole on the core shaft 52, and the upper end of the impeller 60 can engage the shoulder 94 that limits the axial movement but allows rotation. In any event, even if the impeller 60 is not moved axially against the shoulder 94, the clockwise rotation between the end cap 90 on the shaft 52 and the impeller's end cap 92 is not hindered by the angled teeth. Consequently, the core shaft 52 can rotate freely in the bore 62 of the impeller 60, which may tend to remain stationary in the tubing 14 or may even rotate counter-clockwise.

At some point during operation, rotation of the rotating shaft 52 may stop. The built up torsion and the uphole fluid column tends to create backspin as noted previously. When the backspin motion starts, the fluid column above the retarder 50 falls downhole in the tubing string 14 as shown in FIG. 8B.

In this situation, the downward drag between the falling fluid column and the impeller 60 then moves the impeller 60 downhole on the core shaft 52 into an engaged position. At this point, the impeller's end cap 92 mates with the shaft's end cap 90. Because the shaft 52 can have backspin in the counter-clockwise direction, the impeller 60 can also spin counter-clockwise with the core shaft 52 through the engaged end caps 90 and 92. As this occurs, the back-spinning impeller 60 tries to move the fluid column back uphole in the tubing 14 while the fluid is falling downhole. In this way, the retarder 50 uses the force of the fluid and slows the backspin because the resulting torque tends to decelerate the backspin of the core shaft 52.

Figure 9A:
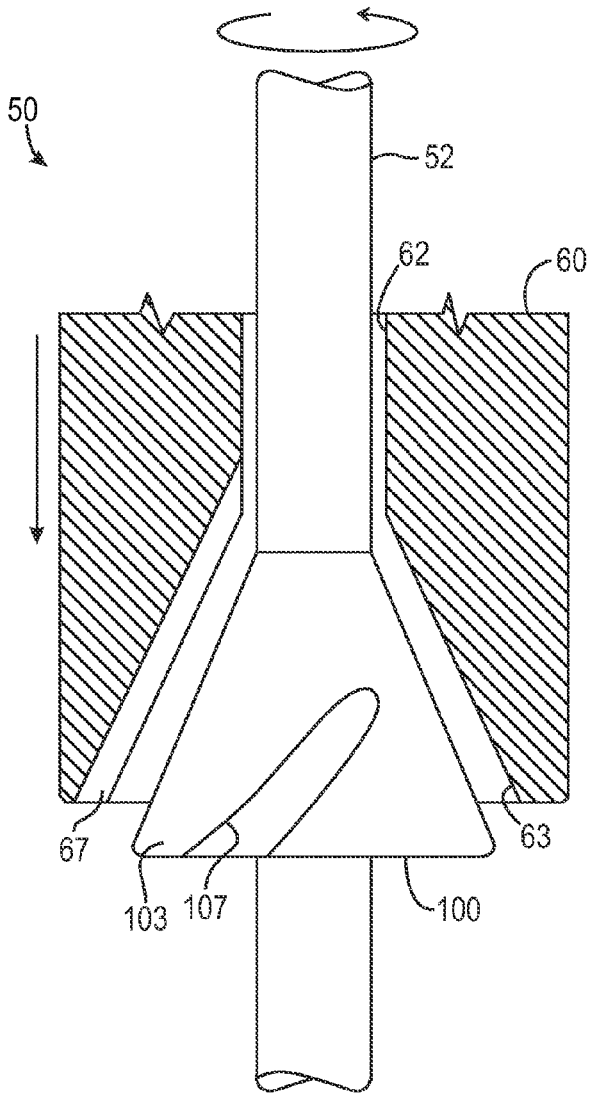
FIGS. 9A-9B show yet another form of engagement for the impeller and core shaft of the disclosed retarder.
Figure 9B:
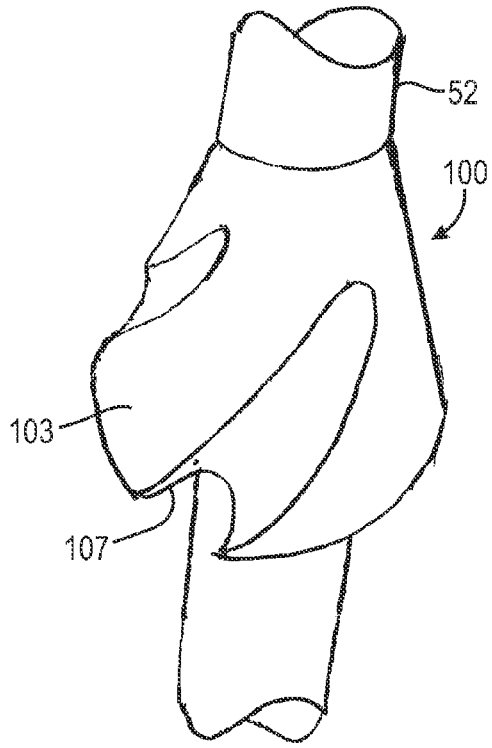

As evidenced by the engagement of the pin and slot arrangement and the end cap arrangement, the disclosed retarder 50 can use a number of mechanisms to engage and disengage the impeller 60 to the rotation of the core shaft 52 depending on whether the core shaft 52 is rotating in a drive direction or a backspin direction. Another way to engage the impeller 60 uses a gear arrangement. As shown in FIGS. 9A-9B, for example, the impeller 60 and an end cap 100 use a set of conic surfaces with grooves similar to helical gears to produce engagement between the impeller 60 and core shaft 52.

As shown, the impeller's central bore 62 defines a conical surface 63 on its end with helically arranged teeth 67 disposed thereabout. The end cap 100 connected on the core shaft 52 has a complementary conical surface 103. Sockets 107 on the surface 103 can engage the teeth 67 of the impeller 60 when the two surfaces 63 and 103 mate with one another.

When the impeller 60 is moved downward by the force of falling fluid and the core shaft's backspin, the conical surfaces 63/103 engage, and the teeth 67 and sockets 107 mate. In this way, the impeller 60 rotates with the core shaft 52 and produces the desired drag. Should the shaft 52 be rotating clockwise as normal and the impeller 60 move downward, the teeth 67/107 of the conical surfaces 63/103 will not engage in the same way. Instead, the surfaces 63/103 tend to push the impeller 60 uphole away from the end cap 100.

Because the weight of the impeller 60 can trend to make it engage, a spring or other bias can be used to balance the equilibrium of forces on the impeller 60 and prevent unintended engagement. Accordingly, one or more biasing springs or the like can be disposed between end caps on the shaft 52 and the ends of the impeller 60 to bias the impeller 60 axially on the shaft 52. The springs can be disposed to bias the impeller 60 uphole or downhole on the shaft 52, depending on the length of the impeller 60, the expected flow past it, the expected backspin, the desired amount of release torque to be provided, and other considerations.

Figure 10A:
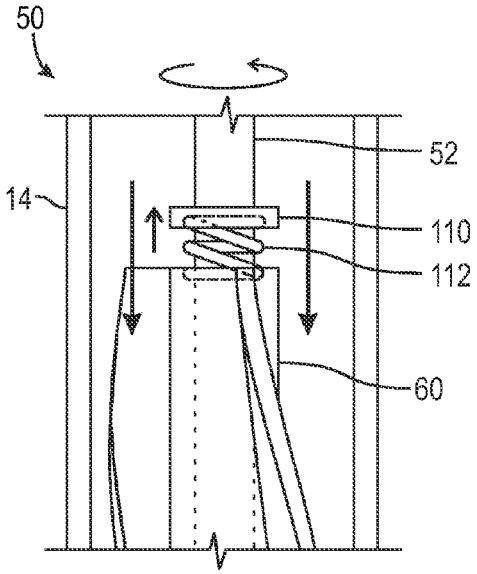
FIGS. 10A-10B show arrangements for biasing the impeller on the core shaft.

As one example, FIG. 10A shows a spring 112 disposed between an end cap 110 and the end of the impeller 60. This spring 112 is in tension and tends to force the impeller 60 uphole, preventing engagement of the impeller 60 with the engagement features disclosed herein (e.g., pin and slot arrangement of FIGS. 6A-6B, shoulder arrangement of FIGS. 8A-8B, and gear arrangement of FIGS. 9A-9B). If necessary, the bias of the spring 112 can maintain a preferred engaged or disengaged condition and can delay the engagement or disengagement until a certain rod string speed and/or fluid velocity is achieved.

Figure 10B:
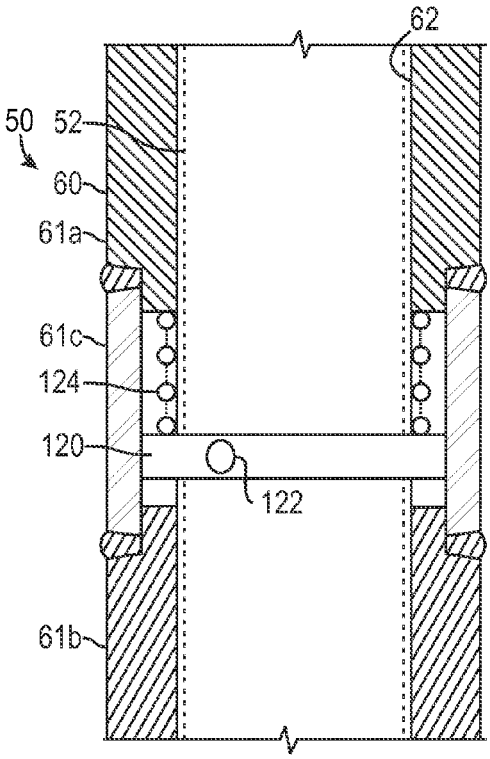

Another biasing arrangement in FIG. 10B uses an internal ring 120 affixed to the shaft 52 with pins 122 or the like. An internal spring 124 on the shaft 52 biases the impeller 60 relative to the fixed ring 120. Here, the internal ring 120 can also limit the axial movement of the impeller 60 on the shaft 52. (In FIG. 10B, the same reference numbers as used elsewhere are provided for corresponding features so that they are not described again here.)

Figure 11:
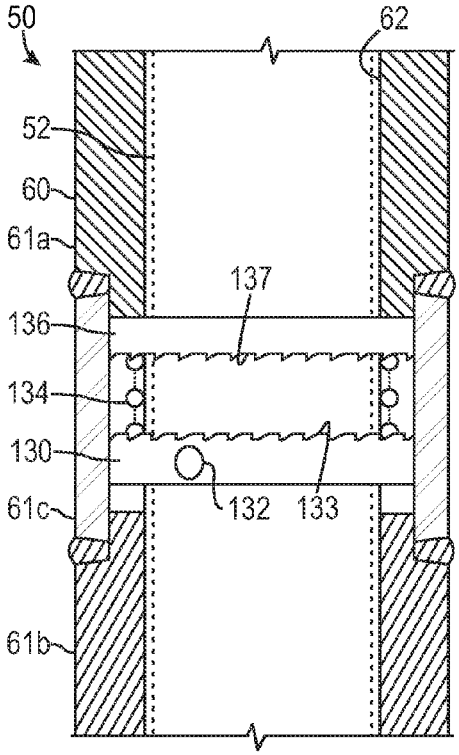
FIG. 11 shown an alternative arrangement for biasing and engaging the impeller and core shaft.

FIG. 11 shows how the disclosed engagement and bias for the impeller 60 can be incorporated together internally. Here, an internal ring 130 affixes to the shaft 52 with pins 132 or the like, and the ring 130 has teeth 133. Opposing this ring 130, the impeller 60 has an internal ring 136 coupled thereto that has complementary teeth 137. An internal spring 134 on the shaft 52 biases the impeller 60 relative to the fixed ring 130. The two rings 130 and 136 remain disengaged unless the downward force of falling fluid causes them to mate against the bias of the spring 134. (The same reference numbers in FIG. 11 are provided for corresponding features described previously so that they are not described again here.)

Figure 12:
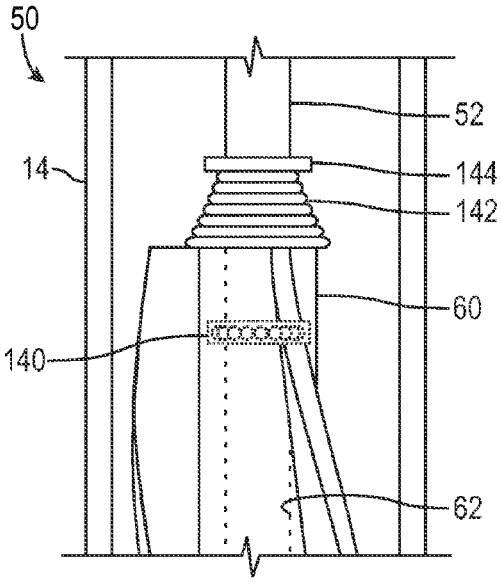
FIG. 12 show additional features to facilitate and protect rotation between the impeller and core shaft.

Finally, the impeller 60 can use bearings, seals, and/or deflectors. As shown in FIG. 12, a bearing 140 can be disposed inside the bore 62 of the impeller 60 and can be in contact with the shaft 52. The bearing 140 can allow for rotation of the shaft 52 relative to the impeller 60 and can also allow for axial movement therebetween. One or more such bearings 140 can be used on the impeller 60 and reduce the detrimental effects of friction and abrasion.

As also shown in FIG. 12, a seal or deflector can be used to prevent abrasive materials (e.g., sand or fines) from being trapped between the impeller 60 and the shaft 52. Here, the seal includes a boot 142 positions between the end of the impeller 60 and an end ring 144 on the shaft 52. The boot 142 can be flexible and can allow the impeller 60 and shaft 52 to rotate and shift axially relative to one another while preventing abrasives from getting between them in the impeller's bore 62.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A backspin retarder for a progressive cavity pump having a drive string disposed in a borehole, the retarder comprising:

an impeller disposed downhole in the borehole and coupling to rotation of the drive string for the progressive cavity pump, the impeller having a disengaged condition and being rotatable in the borehole relative to the rotation of the drive string at least when the drive string rotates in a first direction, and the impeller having an engaged condition and being rotatable in the borehole with the rotation of the drive string at least when the drive string stops rotating in the first direction.

2. The retarder of claim 1, wherein the impeller comprises at least one vane extending outward therefrom.

3. The retarder of claim 1, wherein the at least one vane twists along a length of the impeller.

4. The retarder of claim 1, wherein the retarder comprises a shaft connecting to the rotation of the drive string, the impeller disposed on the shaft.

5. The retarder of claim 4, wherein the impeller is movable axially and radially on the shaft.

6. The retarder of claim 4, further comprising a biasing element disposed on the shaft and biasing the impeller axially thereon.

7. The retarder of claim 4, wherein the impeller defines a slot in an internal bore of the impeller, and wherein the shaft has a pin disposed in the slot.

8. The retarder of claim 7, wherein the slot defines a circumferential section defined around the internal bore and defines at least one catch section connected therefrom.

9. The retarder of claim 8, wherein the pin is disposed in the circumferential section when the impeller has the unengaged condition and disposes in the at least one catch section when the impeller has the engaged condition.

10. The retarder of claim 8, wherein the at least one catch section extends axially uphole from the circumferential section and angles in the second direction.

11. The retarder of claim 4, wherein the shaft comprises a first shoulder limiting axial movement of the impeller on the shaft, the first shoulder engaging portion of the impeller in the engaged condition.

12. The retarder of claim 11, further comprising a second shoulder uphole of the impeller and limiting axial movement of the impeller thereon.

13. The retarder of claim 11, wherein the portion of the impeller defines first teeth, and wherein the first shoulder defines second teeth mating with the first teeth and coupling the rotation of the shaft to the impeller.

14. The retarder of claim 1, wherein the impeller has the disengaged condition when fluid downhole of the impeller flows uphole in the borehole past the impeller.

15. The retarder of claim 1, wherein the impeller has the engaged condition when fluid uphole of the impeller flows downhole in the borehole past the impeller.

16. A backspin retarder for a progressive cavity pump having a drive strings disposed in the borehole, the retarder comprising:

a shaft disposing downhole in the borehole and connecting to rotation of the drive string for the progressive cavity pump; and an impeller disposed in the borehole on the shaft, the impeller having a disengaged condition and being rotatable in the borehole relative to the shaft at least when the shaft rotates in a drive direction, and the impeller having an engaged condition and being rotatable in the borehole with the shaft at least when the shaft stops rotating in the drive direction.

17. A progressive cavity pump, comprising:

a drive;

a pump unit deploying in the borehole downhole of the drive and coupling thereto by a drive string; and a retarder deploying downhole in the borehole and coupling to rotation of the drive string, the retarder permitting the rotation of the drive string relative to the retarder at least when the drive string rotates in a drive direction, the retarder retarding backspin rotation of the drive string at least when the drive string stops rotating in the drive direction.

18. The pump of claim 17, wherein the retarder deploys along the drive string between the pump unit and the drive, deploys downhole of the pump unit on an extension of a rotor of the pump unit, or deploys between the pump unit and another pump unit deployed further downhole.

19. A progressive cavity pumping method, comprising:

lifting fluid in a tubing string by rotating a downhole pump unit with a drive string in a drive direction;

disengaging a retarder in the tubing string from the rotation of the drive string at least when the drive string rotates in the drive direction; and retarding backspin of the drive string at least when the drive string stops rotating in the drive direction by engaging the retarder to the rotation of the drive string and producing drag with the retarder against the fluid in the tubing string.

20. The retarder of claim 16, wherein the impeller comprises at least one vane extending outward therefrom.

21. The retarder of claim 16, wherein the impeller is movable axially and radially on the shaft.

22. The retarder of claim 16, further comprising a biasing element disposed on the shaft and biasing the impeller axially thereon.

23. The retarder of claim 16, wherein to engage and disengage the impeller, a first portion of the impeller engages and disengages a second portion of the shaft.

24. The retarder of claim 16, wherein the impeller has the disengaged condition when fluid downhole of the impeller flows uphole in the borehole past the impeller.

25. The retarder of claim 16, wherein the impeller has the engaged condition when fluid uphole of the impeller flows downhole in the borehole past the impeller.

26. The pump of claim 17, wherein the retarder comprises an impeller disposed downhole in the borehole and coupling to rotation of the drive string for the progressive cavity pump, the impeller having a disengaged condition and being rotatable in the borehole relative to the rotation of the drive string at least when the drive string rotates in the drive direction, and the impeller having an engaged condition and being rotatable in the borehole with the rotation of the drive string at least when the drive string stops rotating in the drive direction.

27. The pump of claim 26, wherein the retarder comprises a shaft connecting to the rotation of the drive string, the impeller disposed on the shaft.

28. The pump of claim 27, wherein the impeller is movable axially and radially on the shaft.

29. The pump of claim 27, further comprising a biasing element disposed on the shaft and biasing the impeller axially thereon.

30. The pump of claim 27, wherein to engage and disengage the impeller, a first portion of the impeller engages and disengages a second portion of the shaft.

31. The pump of claim 26, wherein the impeller has the disengaged condition when fluid downhole of the impeller flows uphole in the borehole past the impeller.

32. The pump of claim 26, wherein the impeller has the engaged condition when fluid uphole of the impeller flows downhole in the borehole past the impeller.

33. The method of claim 19, wherein disengaging the retarder from the rotation of the drive string at least when the drive string rotates in the drive direction comprises disengaging an impeller disposed downhole in the borehole from rotation of the drive string and enabling the impeller to rotate in the borehole relative to the rotation of the drive string at least when the drive string rotates in the drive direction.

34. The method of claim 33, wherein disengaging the impeller comprises disengaging the impeller when fluid downhole of the impeller flows uphole in the borehole past the impeller.

35. The method of claim 33, wherein engaging the retarder to the rotation of the drive string comprises engaging the impeller disposed downhole in the borehole with the rotation of the drive string and enabling the impeller to rotate in the borehole with the rotation of the drive string at least when the drive string stops rotating in the drive direction.

36. The method of claim 35, wherein engaging the impeller comprises engaging the impeller when fluid uphole of the impeller flows downhole in the borehole past the impeller.

37. The method of claim 35, wherein engaging and disengaging the impeller comprises engaging and disengaging a portion of the impeller with a shaft of the retarder on which the impeller is movably disposed.

* * * * *